US005914692A

United States Patent [19]

Bowers et al.

[11] Patent Number: 5,914,692

[45] Date of Patent: Jun. 22, 1999

[54] MULTIPLE LOOP ANTENNA WITH CROSSOVER ELEMENT HAVING A PAIR OF SPACED, PARALLEL CONDUCTORS FOR ELECTRICALLY CONNECTING THE MULTIPLE LOOPS

[75] Inventors: John H. Bowers, Clarksburg; Wen-Liang Wu, Thorofare, both of N.J.

[73] Assignee: Checkpoint Systems, Inc., Thorofare, N.J.

[21] Appl. No.: 08/783,423

[22] Filed: Jan. 14, 1997

[51] Int. Cl.[6] ..... H01Q 11/12

[52] U.S. Cl. ..... 343/742; 343/867; 340/572

[58] Field of Search ..... 343/742, 788, 343/867; 340/572, 505, 825, 286

[56] References Cited

U.S. PATENT DOCUMENTS

| | | | |
|---|---|---|---|
| 2,749,544 | 6/1956 | Pike | 343/867 |
| 3,711,848 | 1/1973 | Martens | 340/280 |
| 4,074,249 | 2/1978 | Minasy | 340/280 |
| 4,135,183 | 1/1979 | Heltemes | 340/572 |
| 4,243,980 | 1/1981 | Lichtblau | 340/572 |
| 4,251,808 | 2/1981 | Lichtblau | 340/572 |
| 4,260,990 | 4/1981 | Lichtblau | 343/742 |
| 4,373,163 | 2/1983 | Vandebult | 343/842 |
| 4,623,877 | 11/1986 | Buckens | 340/572 |
| 4,701,764 | 10/1987 | Malcombe | 343/742 |
| 4,769,631 | 9/1988 | Copeland | 340/551 |
| 4,866,455 | 9/1989 | Lichtblau | 343/742 |
| 4,872,018 | 10/1989 | Feltz et al. | 343/742 |
| 5,005,001 | 4/1991 | Cordery | 340/551 |
| 5,061,941 | 10/1991 | Lizzi et al. | 343/742 |
| 5,103,234 | 4/1992 | Watkins et al. | 343/867 |
| 5,103,235 | 4/1992 | Clements | 343/742 |
| 5,121,105 | 6/1992 | Aittoniemi | 340/572 |
| 5,126,749 | 6/1992 | Kaltner | 343/742 |
| 5,373,301 | 12/1994 | Bowers et al. | 343/742 |

*Primary Examiner*—Don Wong
*Assistant Examiner*—Tan Ho
*Attorney, Agent, or Firm*—Panitch Schwarze Jacobs & Nadel, P.C.

[57] ABSTRACT

A multiple loop antenna is provided which may be connected to either a transmit circuit, a receive circuit, or a transmit/receive circuit. When powered by a transmit circuit, the antenna generates radio frequency magnetic fields in an area or zone proximate to the antenna, but which are substantially canceled at a distance approximately one wavelength and more from the antenna, thereby defining a surveillance zone proximate to the antenna. Radiating loop segments of the antenna are centered around a common feed point and are geometrically symmetrical, such that currents are precisely controlled in each loop segment. A crossover element electrically connects the loop segments. The crossover element includes a pair of spaced, parallel conductors.

29 Claims, 4 Drawing Sheets

MULTIPLE LOOP ANTENNA WITH CROSSOVER ELEMENT HAVING A PAIR OF SPACED, PARALLEL CONDUCTORS FOR ELECTRICALLY CONNECTING THE MULTIPLE LOOPS

BACKGROUND OF THE INVENTION

The present invention relates to radio frequency antennas and more particularly, to loop antennas which generate fields that are generally canceling at distances of one wavelength or more from the antenna.

In certain known types of electronic systems it is known to provide one or more loop antennas wherein coupling between an antenna and its proximate surrounding is high, but wherein the design of the antenna is such that coupling between the antenna and its distant surrounding (i.e., about one wavelength or more distant from the antenna) is minimized. Such antennas are generally used for near-field communications or sensing applications where the term "near field" means within one half wavelength of the antenna. Examples of such applications include communications with implanted medical devices, short range wireless local area communications networks for computers and radio frequency identification systems including electronic article surveillance (EAS) systems. Generally, the coupling to these loop antennas is primarily via magnetic induction.

For example, radio frequency EAS systems usually include both a transmit antenna and a receive antenna which collectively establish a surveillance zone, and tags which are attached to articles being protected. The transmit antenna generates a variable frequency electromagnetic field within a range of a first predetermined frequency. The tags each include a resonant circuit having a predetermined resonant frequency generally equal to the first frequency. When one of the tags is present in the surveillance zone, the field generated by the transmit antenna induces a voltage in the resonant circuit in the tag, which causes the resonant circuit to generate an electromagnetic field, causing a disturbance in the field within the surveillance zone. The receive antenna detects the electromagnetic field disturbance and generates a signal indicating the presence of the tag (and thus, the protected article attached to the tag) in the surveillance zone.

The design of these antennas should satisfy two objectives: (1) to maximize the coupling to the tag over as wide a distance between the transmit and receive antennas as possible, and (2) to minimize the coupling to the far-field. These are conflicting objectives. Prior art antennas, such as those described by Lichtblau in U.S. Pat. Nos. 4,243,980, 4,260,990 and 4,866,455, herein incorporated by reference, generally incorporate two or more loops such that in combination the sizes of each loop, the magnitude of the currents within the loops and the direction of the currents generate fields which, when measured at a point distant from the antenna, generally cancel. In other words, the fields created from each of the loops, when summed, net a field which approaches zero. Such far-field cancellation is not possible when only one loop is used. In figure-eight loop antennas, the loops are generally rectangular, arranged in a coplanar configuration, and offset in position such that at least one side of each loop is proximate to a side of another loop. In other words, the shared sides are immediately adjacent to each other. Lichtblau further discloses in U.S. Pat. Nos. 4,251,808 and 4,866,455, herein incorporated by reference, antennas with shields that are used to prevent electric field coupling to the antennas, but does not disclose any improvement relating to satisfying the two above-stated objectives.

Bowers discloses in U.S. patent application Ser. No. 08/482,680 filed Jun. 7, 1995, now U.S. Pat. No. 5,602,556 an improved two loop (figure 8) configuration as an optional element of a composite antenna, the properties of which include both good far-field cancellation and the generation of rotating fields. The improvement in the two-loop configuration comprises separating the loops from each other such that the shared sides are no longer shared or immediately adjacent to each other. This improvement causes the diameter of the toroid-shaped zone of high coupling proximate to the antenna to be increased, thereby increasing the distance by which the transmit and receive antennas of an EAS system may be separated. However, there is no improvement in this antenna as it relates to the second-stated objective of minimizing coupling to the far-field.

The present invention provides an antenna having both much reduced far-field coupling properties and increased coupling in a zone proximate to the antenna. Generally, the antenna comprises first and second triangular loops of generally equal dimensions and shape wherein the loops are coplanar and positioned on opposite sides of a central axis in the plane of the loops. In addition, the loops are positioned such that one corner of the loops, an outside corner, is proximate to or intersects a corner of a coplanar rectangle defining the outside dimensions of the antenna. The loops are connected to each other by a crossover with a length at least equal to a length of the shortest side of the loops such that when connected to a drive circuit, the current in the loops flows in opposite directions and thereby generates substantially canceling fields. A preferred embodiment of the invention comprises inverting, flipping or mirroring the orientation of the second loop relative to the first loop such that outside corners of the loops are in diagonally opposite corners of the dimension defining rectangle. The antenna can be connected to a transmitting or drive circuit which provides relatively high current and still meet regulatory requirements for far-field radiation. The present invention also provides an antenna which is highly sensitive to externally emitted signals within a zone proximate to the antenna, but highly insensitive to distant emitted signals.

SUMMARY OF THE INVENTION

Briefly stated, the present invention comprises a multiple loop antenna having a first loop element formed generally in the shape of a triangle and a second loop element, also formed generally in the shape of a triangle. The first and second loop elements are of generally equal dimensions and are in generally coplanar, spaced and inverted relationship. An angled crossover element comprising a pair of spaced, parallel conductors electrically couples together the first and second loop elements.

The present invention further provides an electronic article surveillance system. The EAS system includes a transmit circuit element and a transmit antenna electrically coupled to the transmit circuit element for generating electromagnetic fields. The transmit antenna comprises first and second loop elements of generally equal dimensions, each of the elements being formed generally in the shape of a triangle. The loop elements are in generally coplanar, spaced and inverted relationship to each other. An angled crossover element comprising a pair of spaced, parallel conductors electrically couples together the first and second loop elements. A receive antenna is also provided which is spaced from the transmit antenna. The receive antenna is of essentially the same size and geometry as the transmit antenna. A surveillance zone is defined between the transmit antenna and the receive antenna. A receive circuit element is electrically coupled to the receive antenna for detecting the resonance of a resonant marker or tag in the surveillance zone at a predetermined frequency and generating an alarm signal therefrom indicative of the presence of a protected article in the surveillance zone.

In another embodiment, the present invention comprises a multiple loop antenna having a first loop element, a second loop element, and an angled crossover element electrically connecting the first and second loop elements in series. The crossover element comprises a pair of spaced, generally parallel conductors. Preferably, the first and second loop elements are of generally equal dimensions and are in generally coplanar, spaced relationship.

BRIEF DESCRIPTION OF THE DRAWINGS

The foregoing summary, as well as the following detailed description of preferred embodiments of the present invention, will be better understood when read in conjunction with the appended drawings. For the purpose of illustrating the present invention, there are shown in the drawings embodiments which are presently preferred. It should be understood, however, that the present invention is not limited to the particular arrangements and instrumentalities shown. In the drawings.

DETAILED DESCRIPTION OF PREFERRED EMBODIMENTS

Figure 1:
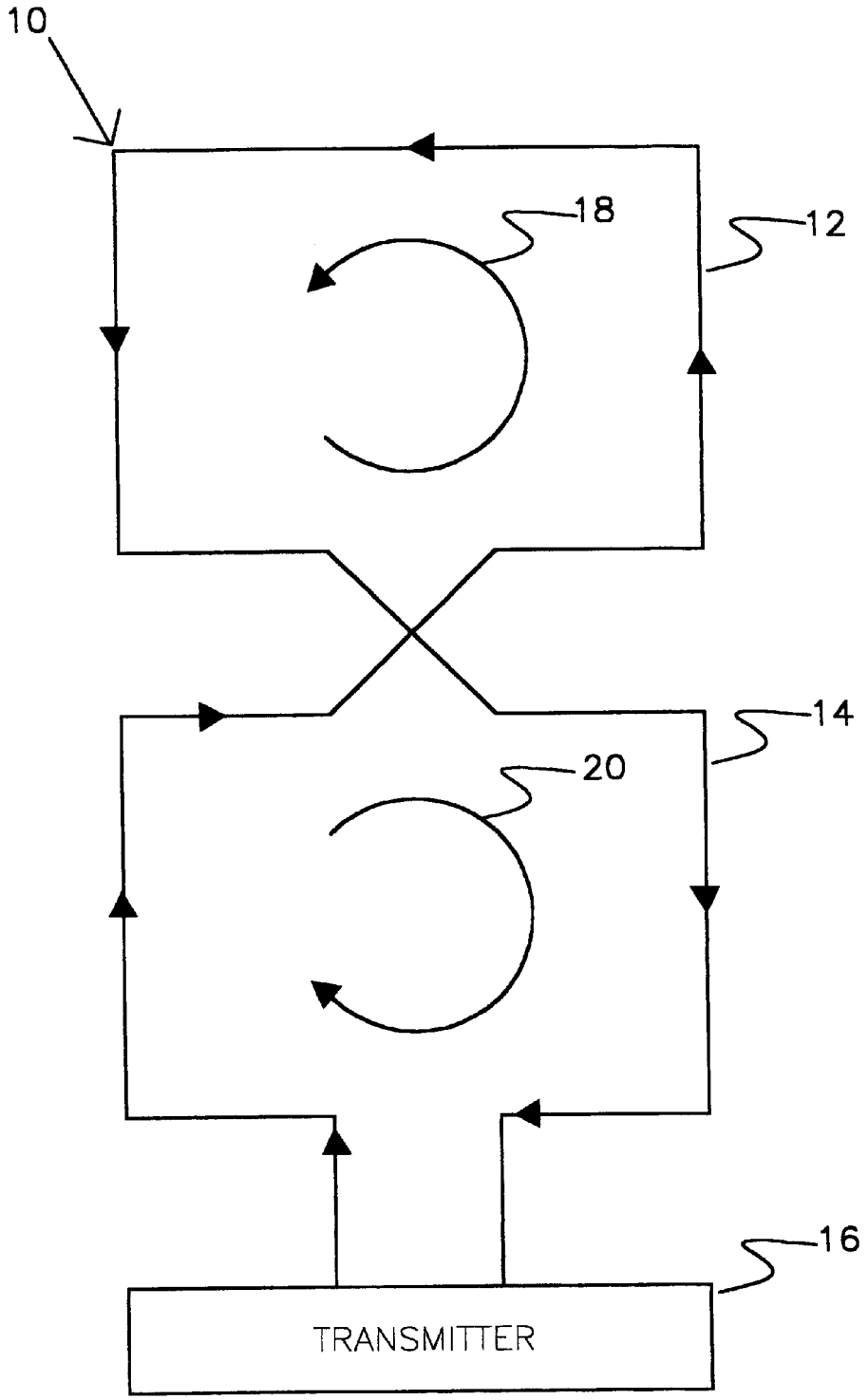
FIG. 1 (PRIOR ART)
FIG. 1 is a schematic diagram of a prior art far-field canceling antenna.

Certain terminology is used in the following description for convenience only and is not limiting. The words "top", "bottom", "lower" and "upper" designate directions in the drawings to which reference is made. The terminology includes the words above specifically mentioned, derivatives thereof and words of similar import.

The present invention is directed to an antenna which can transmit and receive electromagnetic energy primarily via magnetic induction, wherein the size of the antenna is substantially less than the wavelength of the transmitted or received electromagnetic energy. The antenna of the present invention is well suited for use in systems where coupling of energy from or to the antenna primarily occurs proximate (i.e. within less than one-half wavelength) of the antenna. An example of such a system is an EAS system where the antenna is used to establish a surveillance zone. Of course, such an antenna has many other uses as will be apparent to those of skill in the art and the EAS system is but an illustrative example of a use of the antenna.

In an EAS system, the antenna is used to activate a resonant circuit in a security tag and then detect such tag. A security tag (not shown) for use with the present invention is generally of a type which is well known in the art of EAS systems. The tag is adapted to be secured or otherwise borne by an article or item, or the packaging of such article for which security or surveillance is sought. The tag may be secured to the article or its packaging at a retail or other such facility, or secured or incorporated into the article or its packaging, by the manufacturer or wholesaler of the article. The security tag includes components which establish a resonant circuit that resonates when exposed to electromagnetic energy at or near a predetermined detection resonant frequency. Such tags employed in connection with EAS systems, particularly a radio frequency or RF type EAS system, are known in the art and, therefore, a complete description of the structure and operation of such tags is not necessary for an understanding of the present invention. Suffice it to say that such tags resonate or respond when located within a surveilled area or zone, generally proximate to an entrance or exit of a facility, such as a retail store. The resonating tag is then detected by the security system, which activates an alarm to inform personnel that the tag is in the surveilled zone.

Referring now to the drawings in detail, wherein like numerals indicate like elements throughout, there is shown in FIG. 1 a schematic diagram of a prior art far-field canceling antenna 10 of an EAS system for generating and/or coupling to electromagnetic fields, which is disclosed in detail in U.S. Pat. No. 4,243,980 assigned to Checkpoint Systems, Inc. of Thorofare, New Jersey, the disclosure of which is incorporated herein by reference. Generally, the antenna 10 comprises a first, upper loop 12 and a second, lower loop 14, with the upper and lower loops 12, 14 being coplanar. The upper and lower loops 12, 14 are of generally equal dimensions and are generally in the shape of a quadrilateral, such that the overall shape of the combined upper and lower loops 12, 14 is generally rectangular.

The antenna 10 includes a transmitter 16 for supplying a current to the upper and lower loops 12, 14 such that the upper and lower loops 12, 14 radiate electromagnetic fields. The transmitter 16 is connected to the upper and lower loops 12, 14 such that the current flows in the upper loop 12 in a first direction, counter-clockwise as shown by arrow 18, and in the lower loop 14 in a second direction, clockwise as shown by arrow 20, which is opposite to the direction of the current flow in the upper loop 12. It will be understood by those of ordinary skill in the art that the direction of the current flow is representative of only an instant in time. That is, the current flows in the opposite direction during the next half cycle. However, the relative direction of the currents between the upper and lower loops 12, 14 with respect to each other is maintained. As is also known to those of ordinary skill in the art and as previously discussed, the opposing currents generate magnetic fields of generally equal magnitudes but opposite in direction such that the fields substantially cancel in the far-field (i.e., an area multiple wavelengths away from the antenna). For an antenna operating at 8.2 MHZ, the Federal Communications Commission (FCC) defines the far-field as an area thirty meters or slightly less than one wavelength from the antenna.

In an EAS system, a receive antenna (not shown) of generally equivalent dimensions and configuration as the transmit antenna 10, is placed proximate to the antenna 10 for creating a surveillance zone therebetween. Although the antenna configuration disclosed in FIG. 1 generates an adequate surveillance zone for an EAS system, it has been determined that the size of the surveillance zone can be substantially increased by altering the size and shape of the upper and lower loops 12, 14 and introducing a crossover element which connects the upper and lower loops 12, 14. The size of the surveillance zone can be increased because of better meeting the first of the previously described objectives: 1) maximizing the coupling to the tag over as wide a distance between the transmit and receive antennas as possible, and 2) minimizing the coupling to the far-field. Unfortunately, as previously discussed, these are conflicting objectives. Usually an antenna design which improves on one of these objectives sacrifices the other, such that further improvements were presumed not possible.

In the present invention, we have discovered that offsetting or separating the antenna loops from each other improves the performance relative to the first objective. We have also discovered that the shape of the loops (i.e. generally triangular) and the introduction of a crossover element comprising two parallel, closely spaced conductors connecting the loops dramatically reduces the degree of far-field coupling. Each conductor is completely continuous from one end of the crossover element to the other end of the crossover element. Such reduction in far-field coupling has been found to be upwards of a performance factor of ten better than the prior art antenna design. Heretofore, it was assumed that by having loops configured such that the sum of the loop areas multiplied by the magnitude and sign of the currents within them approached zero automatically optimized far field cancellation properties. According to the present invention, further improvement in far field cancellation may be achieved by configuring the antenna in a particular manner. The combination of offsetting the loops, the shape of the loops and the connecting crossover element, achieves the above-discussed competing objectives. In an EAS system, this means that the transmit antenna may be driven with higher currents than previously possible without violating governmental regulations regarding the generation of fields distant from the antenna. Additionally, the receive antenna is more immune to interference from signals that originate at a distance from the antenna.

Figure 2:
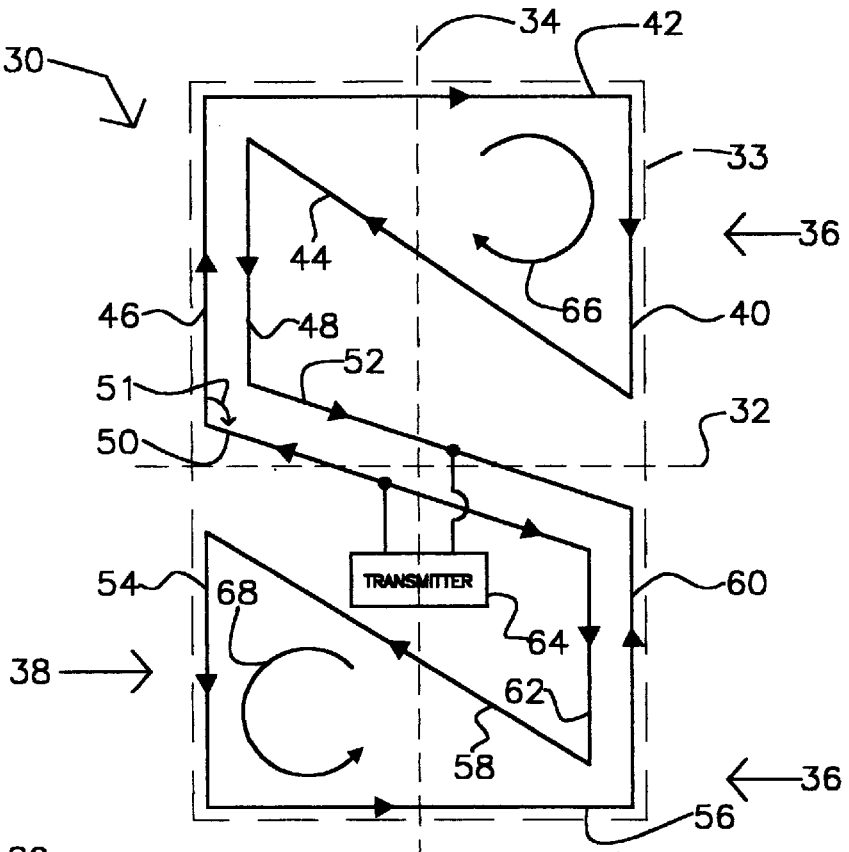
FIG. 2 is a schematic diagram of a far-field canceling antenna in accordance with a first embodiment of the present invention.

Referring now to FIG. 2, a first embodiment of an improved loop antenna 30 is shown. FIG. 2 includes a horizontal axis 32 and a vertical axis 34, each extending generally through the geometric center of the antenna 30 in order to more clearly describe and depict the shape and dimensions of the antenna 30. The antenna 30 basically comprises a first or upper loop 36 located primarily above the horizontal axis 32 and a second or lower loop 38 located primarily below the horizontal axis 32. As shown in FIG. 2 and as is preferred, the upper and lower loops 36, 38 are of generally equivalent size and shape, with the lower loop 38 being spaced from, coplanar and inverted with respect to the upper loop 36. In addition, the overall shape of the antenna 30 is rectangular.

The upper loop 36 and the lower loop 38 each preferably comprise one or more turns of a conductor or wire of any suitable type, such as different gauge size conductors, which conductors are known to those of ordinary skill in the art. Preferably the upper and lower loops 36, 38 are constructed or formed from a single wire. However, it will be appreciated that other conducting elements, such as a multiconductor wire, may be used, if desired, without departing from the scope of the present invention. For example, it may be desirable to use mechanically functional structural elements to make up the first and second loops 36, 38. Alternatively, electrically conductive decorative elements may be used.

The upper loop 36 is generally in the shape of a triangle having a first side 40 which is generally parallel to the vertical axis 34, a second side 42 which is generally parallel to the horizontal axis 32, and a third side 44 extending generally between the first and second sides 40, 42, but not electrically connecting the sides 40, 42 to each other. Rather, a pair of spaced, parallel lines or conductors 46, 48, which preferably are parallel to the vertical axis 34, extend from the second side 42 and the third side 44, respectively, toward the horizontal axis 32. A crossover element connects the upper loop 36 and the lower loop 38. The crossover element comprises a pair of parallel, closely-spaced wires or conductors 50, 52 which have a minimum length to connect the upper and lower loops 36, 38. Preferably, the crossover conductors 50, 52 extend from above the horizontal axis 32 to below the horizontal axis 32. Thus, the crossover conductors 50, 52 extend between the upper and lower loops 36, 38 at an angle 51 with respect to the parallel conductors 46, 48 and the horizontal axis 32. However, it will be understood by those of ordinary skill in the art that the angle 51 can be adjusted one way or the other by various degrees depending upon desired performance requirements for the application of the antenna 30.

Similar to the upper loop 36, the lower loop 38 is generally in the shape of a triangle having a first side 54 which is generally parallel to the vertical axis 34, a second side 56 which is generally parallel to the horizontal axis 32 and a third side 58 extending between the first and second sides 54, 56, but not electrically connecting the sides 54, 56 to each other. Rather, the second side 56 and the third side 58 are connected to a pair of spaced, parallel conductors 60, 62, respectively, which extend parallel to the vertical axis 34 toward the horizontal axis 32. The spaced parallel conductors 60, 62 connect the second and third sides 56, 58 to the crossover conductors 52, 50, respectively.

As can be seen, the upper loop 36 and the lower loop 38 are symmetrical about the horizontal axis 32, with the lower loop 38 generally being an inverted, flipped, or mirror form of the upper loop 36. An outside corner of the upper and lower loops 36, 38 are proximate to opposing corners of a coplanar, dimension defining rectangle 33. That is, the dimensions of the antenna 30 are readily apparent when the antenna 30 is viewed in relation to a coplanar rectangle 33 drawn around the antenna 30. Although each of the upper and lower loops 36, 38 is shown as a right triangle, it is not required that the upper and lower loop comprise a right triangle, but only that the upper and lower loop 36, 38 are of generally triangular shape.

The antenna 30 can be electrically coupled to and driven by an electrical device or circuit, which can be transmitter circuitry in the case of a transmitting antenna, receiver circuitry in the case of a receive antenna, or a transmitter/receiver circuit in the case of an antenna designed for bidirectional communications. In the case of a transmit antenna, the electrical circuit element may comprise a current source electrically coupled to the antenna for supplying current to the antenna sufficient for developing electromagnetic fields. For instance, the electrical circuit could be a conventional transmitter comprising a signal oscillator (not shown) and a suitable amplifier/filter network (not shown) of a type capable of driving the load impedance presented by the antenna. In FIG. 2, a transmitter 64 is connected to the crossover conductors 50, 52 of the antenna 30. Note that the transmitter 64 is connected to each of the crossover conductors 50, 52 such that the transmitter 64 supplies current to the upper and lower loops 36, 38 with the current flowing in opposite directions in the upper and lower loops 36, 38, as indicated by arrows 66, 68, respectively. Current in the upper loop 36 flows in a clockwise direction while current flowing in the lower loop 38 flows in the counter-clockwise direction. As previously discussed, multiple loops with current flowing in opposite directions in the loops provide very effective far-field cancellation.

As will be appreciated, the frequency at which the antenna radiates electromagnetic fields substantially depends on the oscillation rate of the transmitter 64. Thus, the frequency may be set and adjusted by appropriately adjusting the transmitter 64 in a well-known manner. Preferably, the antenna 30 is operative at radio frequencies, which preferably include frequencies above 1,000 Hz, and more preferably include frequencies above 5,000 Hz, and even more preferably include frequencies above 10,000 Hz. However, it should be understood that the antenna 30 could be operated at lower frequencies without departing from the scope of the present invention. In the presently preferred embodiment, the tag preferably resonates at or near 8.2 MHz, which is one commonly employed frequency used by electronic security systems from a number of manufacturers, although it will be apparent to those of ordinary skill in the art that the frequency of the EAS system may vary according to local conditions and regulations. Thus, this specific frequency is not to be considered a limitation of the present invention.

Alternatively, the electrical circuit may comprise receiver circuitry electrically coupled to the antenna 30 for receiving electromagnetic energy from a transmitting antenna and/or the resonant circuit of a tag (not shown) for generating a signal indicative of whether a tag is present in the vicinity of the antenna. Electrical circuit elements of the type used in the present invention for transmitting and/or receiving are generally known. Such circuit elements are described, for instance, in U.S. Pat. No. 5,373,301. A more detailed description of the electrical circuit element is not required to understand the present invention.

In the presently preferred embodiment, the electrical device is coupled to the antenna 30 at a center about which the antenna 30 is geometrically symmetric. Coupling the electrical device proximate to the center of the antenna 30 contributes to providing equal currents through the equivalent conductor segments that comprise the crossover and loops on opposite sides of the center of the antenna 30, thereby obtaining precise cancellation of the fields at a distance from the antenna 30, when the antenna 30 is connected to the transmitter 64. Thus, far-field coupling is minimized. In a reciprocal fashion, when connected to a receiver, the sensitivity of the antenna 30 to signals at a distance from the antenna 30 is minimized. Although it is presently preferred to locate the electrical coupling to the antenna 30 at a geometric center of the antenna 30, it is not required that the non-radiating elements associated with the feed of the antenna 30, such as non-radiating feed wires (not shown) to/from the electrical device, be considered in determining the geometric center of the antenna 30. However, the conductor elements of the antenna 30 that carry current from the feed point to the radiating loops (i.e., the crossover conductors 50, 52) are germane to determining the center of the antenna 30 and to the geometric design of the antenna 30. Although the electrical coupling to the antenna 30 is preferably connected proximate the geometric center of the antenna 30, as this location is, in general, optimum, it will be understood that connections could be made at other points along the antenna 30.

The upper and lower loops 36, 38 of the antenna 30 are preferably positioned in diagonally opposite corners of the dimension defining rectangle in order to extend the size of the zone proximate to the antenna 30 in which the coupling to the antenna 30 is relatively high. The antenna 30 is designed to maximize the magnetic coupling coefficient of the antenna in as large a zone as possible proximate to the antenna. Causing the lower loop 38 to be located diagonally opposite the upper loop 36, as shown, has been found to provide better overall coupling to tags within the surveillance zone for EAS applications, and therefore better overall detection of the tags, due to the angle relative to the vertical axis 34 of the toroidal zone of high coupling characteristic of the antenna 30. The antenna 30 comprises a configuration of wire or conductors for carrying current and generating fields, with substantially reduced far-field coupling, thereby allowing the antenna 30 to be driven with substantially higher currents than prior art figure-8 antenna configurations without violating governmental radiation regulations. That is, when connected to the transmitter 64, the antenna 30 generates radio frequency magnetic fields in a zone proximate to the antenna 30 but such that the fields are largely canceled at a distance, approximately one wavelength and more, from the antenna.

Figure 3:
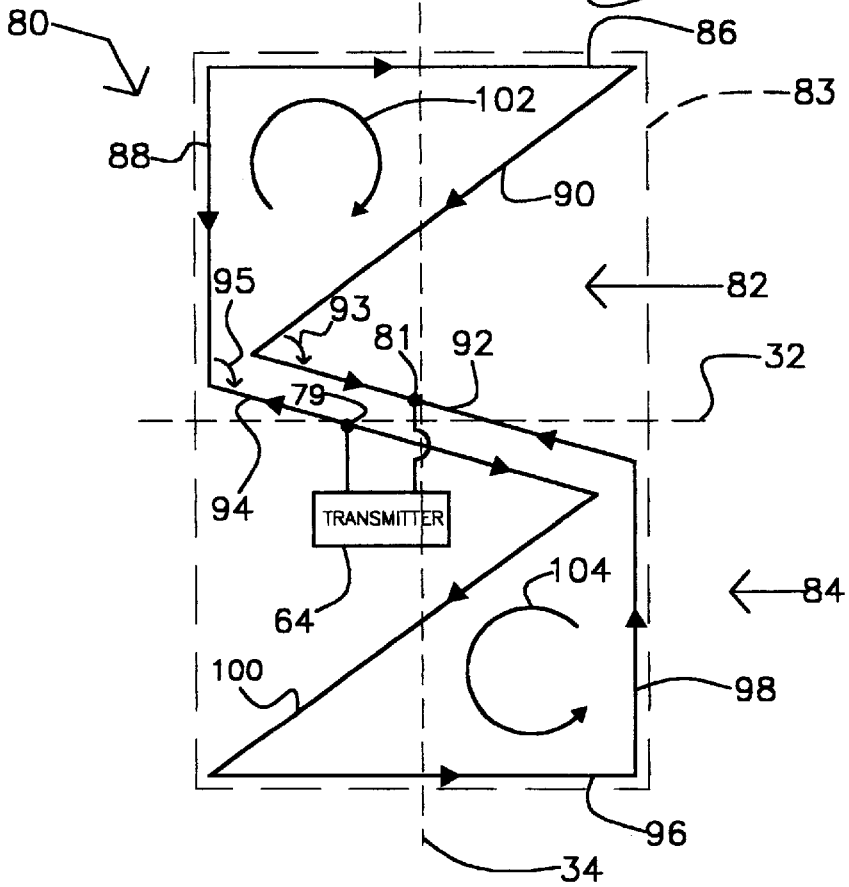
FIG. 3 is a schematic diagram of a far-field canceling antenna in accordance with a second embodiment of the present invention.

Referring now to FIG. 3, a second embodiment of a multiple loop antenna is indicated at 80. The antenna 80 basically comprises a first loop 82 and a second loop 84 which is coplanar with the first loop 82. In the drawing, the first loop 82 is located above a horizontal axis 32 and the second loop 84 is located below the horizontal axis 32. Thus, the first loop 82 is also referred to herein as the upper loop and the second loop 84 is referred to as the lower loop. However, it will be apparent to those of ordinary skill in the art that the descriptive terms "upper" and "lower" are relative, and that the loops 82, 84 could be oriented in other orientations with respect to each other, such as side-by-side, without departing from the scope of the invention. Like the antenna 30 (FIG. 2), the upper and lower loops 82, 84 of the antenna 80 are of generally equivalent size and shape, with the lower loop 84 being spaced, coplanar and inverted with respect to the upper loop 82. Also like the antenna 30, the upper and lower loops 82, 84 are generally in the shape of a triangle, although the orientation of these "triangles" differs from the orientation of the "triangles" (loops 36, 38) of the antenna 30.

The upper loop 82 has a first side 86 which is generally parallel to the horizontal axis 32, a second side 88 which is generally parallel to a vertical axis 34, and a third side 90 extending between the first and second sides 86, 88 but not electrically connecting the sides 86, 88 to each other. Rather, the third side 90 connects the first side 86 to a first crossover conductor 92. The first crossover conductor 92 extends from an end of the third side 90 at a point above the horizontal axis 32 to a point below the horizontal axis 32. An angle 93 formed by the third side 90 and the first crossover conductor 92 is preferably an acute angle, such that the crossover conductor 92 extends from above the horizontal axis 32 to below the horizontal axis 32. Similarly, the second side 88 is connected to a second crossover conductor 94, which is generally parallel to the first crossover conductor 92 and extends from a point above the horizontal axis 32 to a point below the horizontal axis 32. An angle 95 formed by the second side 88 and the second crossover conductor 94 is preferably an obtuse angle, such that the second crossover conductor 94 extends from a point above the horizontal axis 32 to a point below the horizontal axis 32, and connects the upper loop 82 to the lower loop 84.

Similar to the upper loop 82, the lower loop 84 is generally in the shape of a triangle having a first side 96 which is generally parallel to the horizontal axis 32, a second side 98 which is generally parallel to the vertical axis 34 and a third side 100 extending between the first and second sides 96, 98, but not electrically connecting the sides 96, 98 to each other. Rather, the second side 98 and the third side 100 are connected to the first and second crossover conductors 92, 94, respectively, at a point below the horizontal axis 32. As can be seen, the upper loop 82 and the lower loop 84 are symmetrical about the horizontal axis 32, with the lower loop 84 generally being an inverted form of the upper loop 82. The overall shape of the antenna 80 is generally rectangular.

An electrical circuit element, in this case the transmitter 64, is preferably connected to the first and second crossover conductors 92, 94 for transmitting an electrical current through the antenna 80, in the case of a transmit antenna. Arrows 102, 104 are shown in the upper and lower loops 82, 84, respectively, indicating the direction of current flow in each of the loops 82, 84. Current in the upper loop 82 flows in a clockwise direction (arrow 102) while the current in the lower loop 84 flows in the counter-clockwise direction (arrow 104). As previously discussed, providing multiple loops with current flowing in opposite directions in the loops provides very effective far-field cancellation.

As with the antenna 30, the antenna 80 can be connected to an electrical device, which can be either a transmitter, a receiver, or a transmitter/receiver. In the presently preferred embodiment, the transmitter 64 is connected to the antenna 80 at connection points 79, 81 along the crossover conductors 94, 92, respectively, such that the transmitter 64 is located and connected at a center point about which the antenna 80 is geometrically symmetric. As previously discussed, positioning the transmitter 64 at the center of the antenna 80 contributes to providing a symmetric current distribution along the conductor or wire segments of the antenna 80, thereby obtaining precise cancellation of the magnetic fields at a distance from the antenna 80.

The upper and lower loops 82, 84 of the antenna 80 are positioned in diagonally opposite corners of a dimension defining rectangle 83 extending around a perimeter of the antenna 80. In addition, the upper and lower loops 82, 84 are separated or spaced from each other, with a center point of each loop 82, 84 located as far as possible from each other, such that the third side 90 of the upper loop 82 and the third side 100 of the lower loop 84 are not immediately adjacent to each other. Spacing the adjacent sides causes the diameter of the toroid-shaped zone of high coupling proximate to the antenna to be increased, thereby increasing the distance by which the transmit and receive antennas of an EAS system may be separated.

Figure 4:
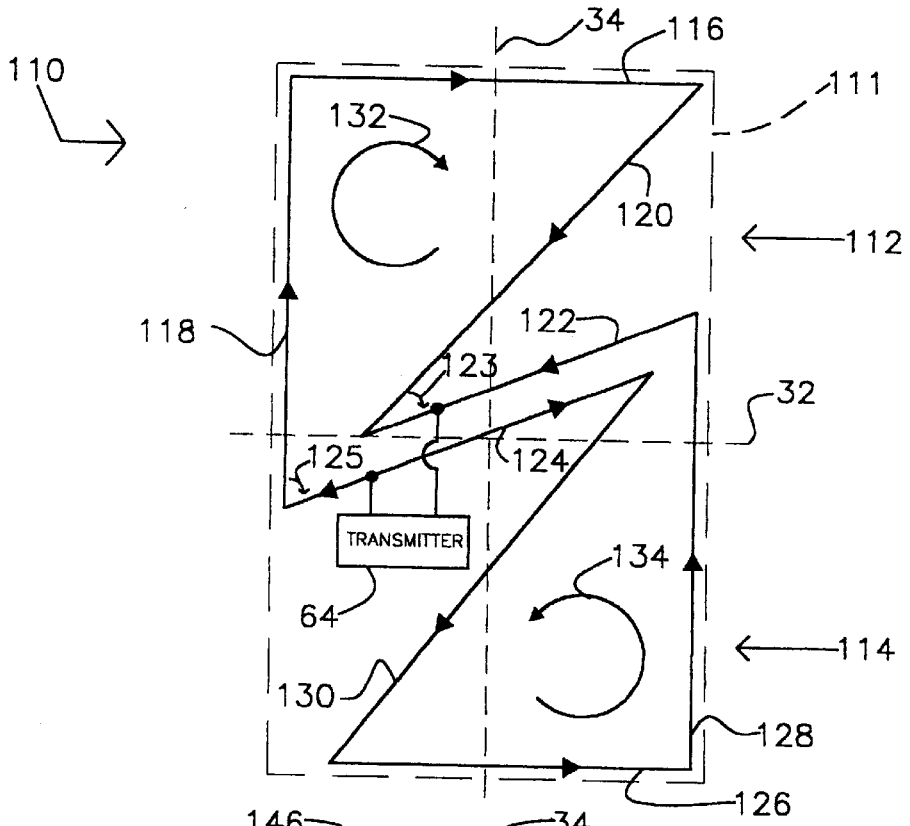
FIG. 4 is a schematic diagram of a far-field canceling antenna in accordance with a third embodiment of the present invention.

Referring now to FIG. 4, a third embodiment of a multiple loop antenna is indicated at 110. The antenna 110 comprises a first, upper loop 112 and a second, lower loop 114. The upper and lower loops 112, 114 are coplanar and of generally equivalent size and shape, with the lower loop 114 being spaced from and inverted with respect to the upper loop 112. Also, the upper and lower loops 112, 114 are preferably generally triangular in shape. The upper loop 112 is located primarily above a horizontal axis 32, but a small portion does extend below the horizontal axis 32. Similarly, the lower loop 114 is located primarily below the horizontal axis 32, but a small portion of the lower loop 114 extends above the horizontal axis 32. However, the overall shape of the antenna 110 is generally rectangular. As with the antenna 80 (FIG. 3), it will be apparent to those of ordinary skill in the art that the descriptive terms "upper" and "lower" are relative, and that the loops 112, 114 could be oriented in other orientations with respect to each other, such as side-by-side, without departing from the scope of the invention.

The upper loop 112 has a first side 116 which is generally parallel to the horizontal axis 32, a second side 118 which is generally parallel to the vertical axis 34, and a third side 120 extending between the first and second sides 116, 118 but not electrically connecting the sides 116, 118 to each other. Rather, the third side 120 is connected to a first crossover conductor 122, which extends from a point below the horizontal axis 32 to a point above the horizontal axis 32 and connects the upper loop 112 to the lower loop 114. An angle 123 formed between the third side 120 and the first crossover conductor 122 is preferably an acute angle, such that the first crossover conductor 122 extends from below the horizontal axis 32 to a point above the horizontal axis 32.

Similarly, the second side 118 is connected to a second crossover conductor 124 which is generally parallel to the first crossover conductor 122. The second crossover conductor 124 extends from a point below the horizontal axis 32 to a point above the horizontal axis 32, and connects the upper loop 112 to the lower loop 114. An angle 125 formed by the second side 118 and the second crossover conductor 124 is preferably an acute angle.

The lower loop 114 has a first side 126 which is generally parallel to the horizontal axis 32, a second side 128 which is generally parallel to the vertical axis 34 and a third side 130 extending between the sides 126, 128, but not electrically connecting the sides 126, 128 to each other. Rather, the second side 128 and the third side 130 are connected to the first and second crossover conductors 122, 124, respectively, at a point above the horizontal axis 32. Thus, the shape of the antenna 110 is like a "zig-zag".

The upper and lower loops 112, 114 of the antenna 110 are positioned in diagonally opposite corners of a dimension defining rectangle 111 extending around an outer perimeter of the antenna 110, such that a toroidal field is generated by the antenna 110 having an angle relative to the vertical axis 34. In addition, the upper and lower loops 112, 114 are separated or spaced from each other such that the diameter of the toroid-shaped zone of high coupling proximate to the antenna 110 is increased.

The transmitter 64 is connected to the crossover conductors 122, 124 and generates a current which flows through the upper and lower loops 112, 114. Arrows 132, 134 are shown in the upper and lower loops 112, 114, respectively, indicating the direction of (instantaneous) current flow in each of the loops 112, 114. Current in the upper loop 112 flows in a clockwise direction while the current flowing in the lower loop 114 flows in the counter-clockwise direction. As previously discussed, providing multiple loops with current flowing in opposite directions in the loops provides very effective far-field cancellation.

The antenna 110 achieves excellent far-field cancellation. In addition, noise pickup from distant sources is quite low, such that the antenna 110 is desirable in locations where, for instance, other EAS systems are installed nearby. It is presently preferred that an electrical device connected to the antenna 110 (e.g., a transmitter or a receiver) is connected at a center point, such as where the horizontal axis 32 intersects the vertical axis 34, such that the antenna 110 is symmetrical about the electrical device. As previously discussed, positioning the electrical device at the center of the antenna 110 contributes to providing equal current distribution along the wire segments of the antenna 110, thereby obtaining precise cancellation of the electromagnetic fields at a distance from the antenna 110 when the antenna 110 is connected to a transmitter.

Figure 5:
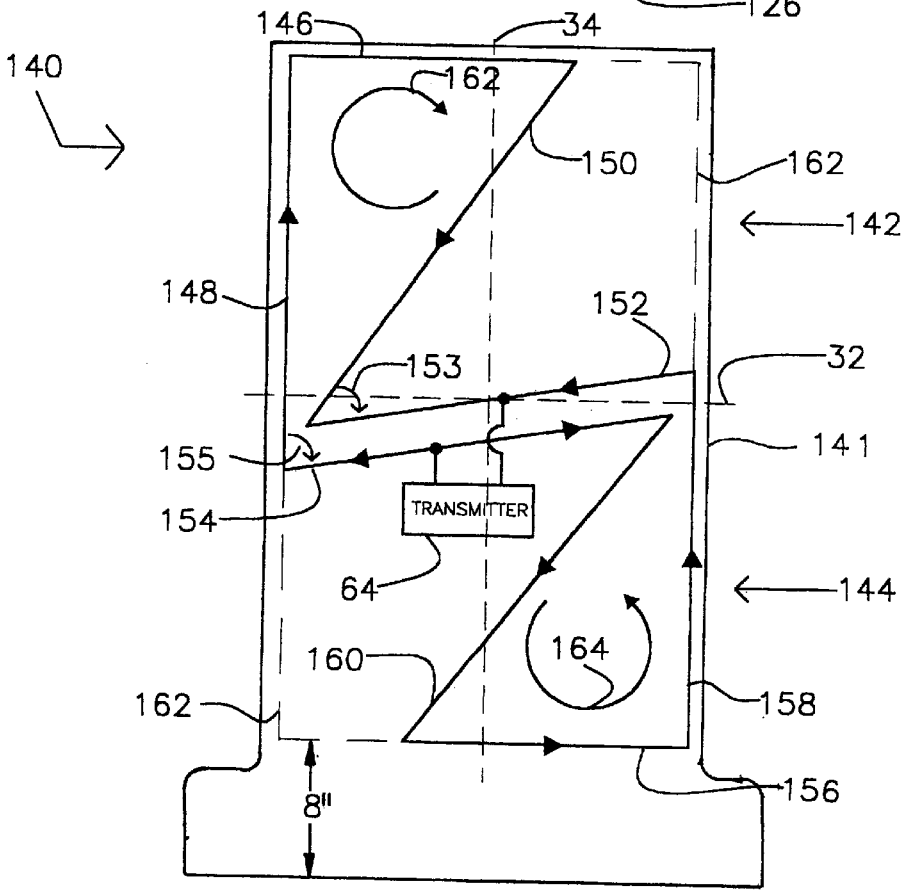
FIG. 5 is a schematic diagram of a far-field canceling antenna in accordance with a fourth embodiment of the present invention.

Referring now to FIG. 5, a fourth embodiment of a multiple loop antenna is indicated at 140. The antenna 140 comprises a first, upper loop 142 and a second, lower loop 144. The upper and lower loops 142, 144 are of generally equivalent size and shape, with the lower loop 144 being spaced, coplanar and inverted with respect to the upper loop 142. The upper and lower loops 142, 144 are generally in the shape of a triangle. The upper loop 142 is located primarily above the horizontal axis 32, but a small portion of the upper loop 142 extends slightly below the horizontal axis 32. Similarly, the lower loop 144 is located primarily below the horizontal axis 32, but a small portion of the lower loop 144 extends above the horizontal axis 32. Although the loops 142, 144 are described in terms of "upper" and "lower", it will be apparent to those of ordinary skill in the art that these descriptive terms are relative, and that the loops 142, 144 could be oriented in other orientations with respect to each other, such as side-by-side, without departing from the scope of the invention.

The upper loop 142 has a first side 146 which is generally parallel to the horizontal axis 32, a second side 148 which is generally parallel to a vertical axis 34, and a third side 150 extending between the sides 146, 148 but not electrically connecting the sides 146, 148 to each other. Rather, the third side 150 is connected to a first crossover conductor 152, which extends from a point below the horizontal axis 32 to a point above the horizontal axis 32 and connects the upper loop 142 to the lower loop 144. An angle 153 formed between the third side 150 and the first crossover conductor 152 is preferably an acute angle, such that the first crossover conductor 152 extends from below the horizontal axis 32 to a point above the horizontal axis 32.

Similarly, the second side 148 is connected to a second crossover conductor 154 which connects the second side 148 to the lower loop 144. The second crossover conductor 154 is spaced from and generally parallel to the first crossover conductor 152. An angle 155 formed by the side 148 and the second crossover conductor 154 is preferably an acute angle, such that the second crossover conductor 154 extends from a point below the horizontal axis 32 to a point above the horizontal axis 32.

The lower loop 144 has a first side 156 which is generally parallel to the horizontal axis 32, a second side 158 which is generally parallel to the vertical axis 34 and a third side 160 extending between the sides 156, 158, but not electrically connecting the sides 156, 158 to each other. Rather, the second side 158 and the third side 160 are connected to the first and second crossover conductors 152, 154, respectively, at a point above the horizontal axis 32, such that the upper and lower loops 142, 144 are interconnected.

The upper and lower loops 142, 144 of the antenna 140 are positioned in diagonally opposite corners of a dimension defining rectangle 162 extending around an outer perimeter of the antenna 140 such that a toroidal field is generated by the antenna 140 having an angle relative to the vertical axis 34. Moreover, the upper and lower loops 142, 144 are separated or spaced from each other, with a center point of each loop 142, 144 located as far as possible from each other such that the diameter of the toroid-shaped zone of high coupling proximate to the antenna 140 is increased.

The antenna 140 is thus far similar to the antenna 110 (FIG. 4). However, the antenna 140 differs from the antenna 110 in that a length of the first side 146 of the upper loop 142 and a length of the first side 156 of the lower loop 144 is less than a distance between the second side 148 of the upper loop 142 and the second side 158 of the lower loop 144. That is, the length of each of the first sides 146, 156 is less than the length of the sides of the dimension defining rectangle 162. Thus, the upper and lower loops 142, 144 are spaced further apart than the upper and lower loops 112, 114 of the antenna 110. In addition, the crossover conductors 152, 154 of the antenna 140 are spaced closer together than the crossover conductors 122, 124 of the antenna 110. The main effect of providing the first sides 146, 156 with a length less than a width of the dimension defining rectangle is to orient a toroidal field generated by the antenna 140 at a higher angle relative to the vertical axis 34 than a toroidal field generated by the antenna 110 (in which a length of the sides 116, 126 is equivalent to a width of a dimension defining rectangle). In an EAS application, this helps to improve detection of a tag oriented in a vertical plane perpendicular to the planes of the antenna 140.

A preferred embodiment of the antenna 140 was constructed in which the first sides 146, 156 had a length of approximately 15.0 inches, the second sides 148, 158 had a length 31.6 inches and the third sides 150, 160 had a length of approximately 34.98 inches. The distance separating the second side 148 of the upper loop 142 from the second side 158 of the lower loop 144 is approximately 22.5 inches and thus, the amount of overlap between the upper loop 142 and the lower loop 144 is approximately 3.75 inches. That is, the first side 146 of the upper loop 142 and the first side 156 of the lower loop 144 each extends only approximately 3.75 inches beyond the vertical axis 34. The crossover conductors 152, 154 are separated by a distance of approximately 0.1 inches.

In an EAS system, it is preferred that the antenna 140 is housed within a decorative structure constructed of a non-conductive material, such as a polymeric material with the antenna 140 being positioned approximately 8.0 inches above the floor or ground plane. Accordingly, an antenna in accordance with the present invention used in an EAS system is preferably housed in a rigid support structure 141.

The antenna 140 achieves excellent far-field cancellation. In addition, noise pickup from distant sources is quite low, such that the antenna 140 is desirable in locations where, for instance, other EAS systems are installed nearby. It is presently preferred that an electrical device connected to the antenna 140 (e.g., a transmitter or a receiver) is connected at a center point, such as where the horizontal axis 32 intersects the vertical axis 34, such that the antenna 140 is symmetrical about the electrical device. As previously discussed, positioning the electrical device at the center of the antenna 140 contributes to providing a symmetric current distribution along the wire segments of the antenna 140, thereby obtaining precise cancellation of the magnetic fields at a distance from the antenna 140 when the antenna 140 is connected to a transmitter.

The antenna 140 is also shown connected to the transmitter 64, which provides current to the antenna 140. The transmitter 64 is connected to the crossover conductors 152, 154 such that current flows in opposite directions in the upper and lower loops 142, 144. Arrows 162, 164 are shown in the upper and lower loops 142, 144, respectively, indicating the direction of current flow in each of the loops 142, 144. Current in the upper loop 142 flows in a clockwise direction while the current flowing in the lower loop 144 flows in the counter-clockwise direction to thereby achieve effective far-field cancellation.

Typically, the spacing in an EAS system between the transmit antenna and receive antenna is in the range of from two to five feet depending upon the particular EAS system and the particular application in which the system is being employed. The aforedescribed antenna designs provide a larger surveillance zone then prior art antennas. For instance, EAS systems are usually located at an entry/exit of a retail store, with a typical system having a transmit antenna located on a first side of the entry/exit and a receive antenna located on a second, opposite side of the entry/exit. In order to avoid inhibiting entry/exit to the establishment, it is desirable that the antennas be spaced from each other by at least the width of the entry/exit, which is generally about six feet.

Unfortunately, many prior art systems require the transmit and receive antennas to be spaced from each other at a distance of much less than five feet, requiring persons to be funneled through a space more narrow than the entry/exit, or for more than two antennas to be used at the entry/exit. However, due to the excellent far field cancelling properties of the antenna designs of the present invention, a transmitter connected to the antenna 30, 80, 110, 140 may be operated at a very high power without creating far field emissions that violate FCC regulations. In addition, since a signal generated by a tag in a surveillance zone of the antenna 30, 80, 110, 140 is proportional in amplitude to the amplitude of the signal used to drive the antenna 30, 80, 110, 140 a net increase in the tag signal is achieved, which provides a corresponding increase in the signal to noise ratio of the system. This increase in the signal to noise ratio allows a transmit antenna to be located further from a receive antenna than present EAS systems. For instance, the transmit and receive antennas may be located on opposite sides of a standard six foot store entry, which allows customers to pass more easily into and out of the store.

Another advantage of placing the antenna loops in diagonally opposite corners (of a dimension defining rectangle) is that a diameter of the toroidal field created by the antenna when connected to a transmitter is increased. Hence, the zone of maximum coupling to the tag is increased.

Figure 6:
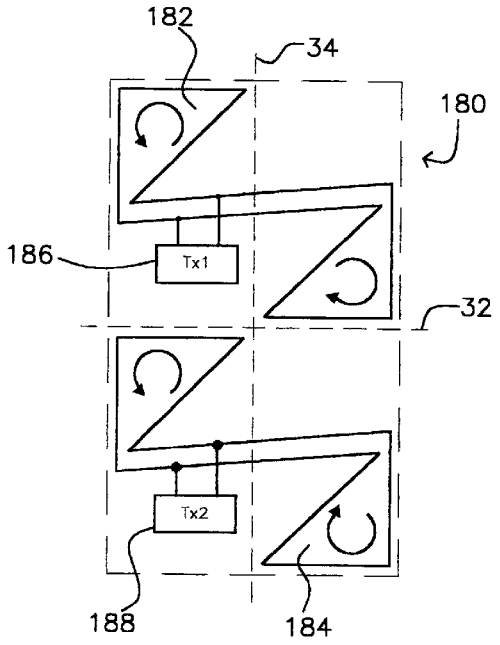
FIG. 6 is a schematic diagram of a far-field canceling antenna system including two far-field canceling antennas in accordance with the present invention.
Figure 7:
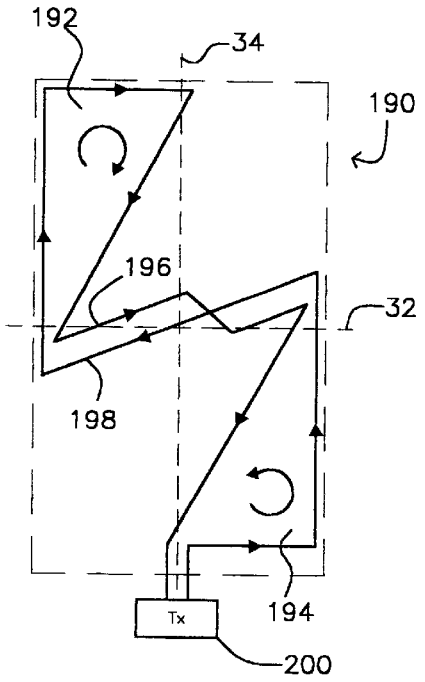
FIG. 7 is a schematic diagram of a far-field canceling antenna having a series connected transmitter in accordance with the present invention.
Figure 8:
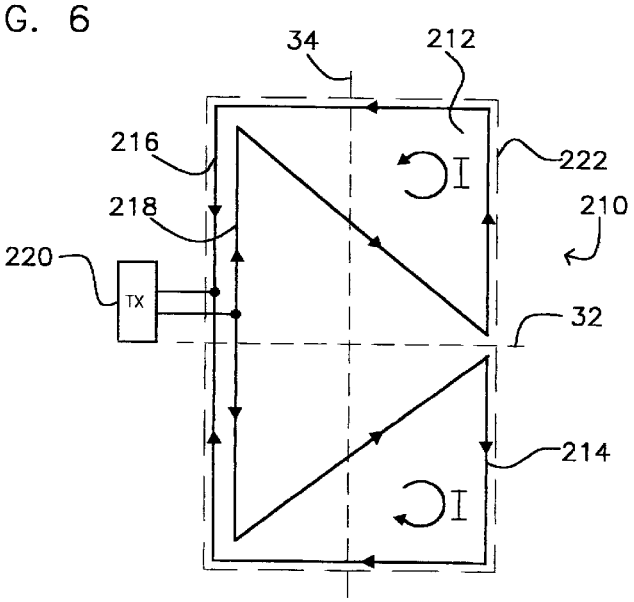
FIG. 8 is a schematic diagram of an antenna in accordance with a fifth embodiment of the present invention.

Referring now to FIGS. 6–8, three additional alternative embodiments of the present invention are shown. In FIG. 6, a transmit antenna system 180 is shown comprising a first or upper transmit antenna 182 and a second, lower transmit antenna 184. The upper and lower antennas 182, 184 are of generally equivalent size and shape, with the lower antenna 184 being spaced from and coplanar with the upper antenna 182. That is, the lower antenna 84 lies below a horizontal axis 32 and the upper antenna 182 lies above the horizontal axis 32. The upper and lower antennas 182, 184 each comprise "zig-zag" antennas in accordance with the present invention. In particular, the upper and lower antennas 182, 184 are each configured similar to the antenna 110 (FIG. 4). It will be understood by those of ordinary skill in the art that the terms "upper" and "lower" are relative and only used to describe the first and second antennas 182, 184 as shown in the drawing, and that the first and second antennas 182, 184 could be placed side-by-side, as opposed to one over the other.

The upper and lower antennas 182, 184 are connected to respective first and second transmitters 186, 188 for transmitting an electrical current through the respective antennas 182, 184. In accordance with the desired far-field cancelling property previously discussed, the first transmitter 186 preferably transmits a signal at 0° phase and the second transmitter 188 transmits a signal at 90° phase. Alternatively, the first antenna may be operated over a time which is different than that over which the lower antenna 184 is operated. Of course, it will be understood that the first and second antennas 182, 184 could be connected to first and second receivers (not shown), as opposed to transmitters for detecting a signal within a field generated by a transmitting antenna.

FIG. 7 shows a "zig-zag" antenna 190 comprising a first, upper loop 192, a second, lower loop 194, and a pair of crossover conductors 196, 198 connecting the upper loop 192 with the lower loop 194. The antenna 190 is similar in size, shape and configuration as the antenna 110 (FIG. 4) except that the antenna 190 is connected to a transmitter 200 with a series connection (as opposed to the parallel connected transmitter 64 of FIG. 4). In addition, since the antenna 190 is series connected to the transmitter 200, the crossover conductors 196, 198, while closely spaced, actually cross-over in order that the current transmitted through the upper loop 192 flows in a direction opposite to the current in the lower loop 194. Since the transmitter 200 is connected proximate to the lower loop 194, the current flow through the upper and lower loops 192, 194 is non-symmetric. In order to balance the fields generated by the current flow through the upper loop 192 and the lower loop 194, the relative dimensions of the upper and lower loop 192, 194 are adjusted.

FIG. 8 is a schematic diagram of an antenna 210 having a first, upper loop 212, a second, lower loop 214 which is spaced from and coplanar with the upper loop 212, and a pair of closely spaced parallel conductors 216, 218 connecting the upper loop 212 and the lower loop 214. A transmitter 220 is parallel connected to the antenna 210 at the parallel conductors 216, 218, such that a generated current flows in opposite directions in the upper loop 212 and the lower loop 214, as indicted by respective arrows. Similar to the other antennas (30, 80, 110) of the present invention, the antenna 210 has a generally rectangular shape, as indicated by a dimension defining rectangle 222. However, different from the other disclosed embodiments, the upper and lower loops 212, 214 are located in vertically opposite corners of the rectangle 222 (as opposed to diagonally opposite corners). While the antenna 210 is not preferred for use in an EAS system, other uses for the antenna 210 may become apparent to those of ordinary skill in the art. For example, this configuration of the invention may be useful for communicating with medical devices implanted in a patient.

Although particular embodiments of the present invention have been described, it will be apparent that the present invention may be altered or modified, yet still provide the desired far-field cancellation without departing from the scope and spirit of the invention. Moreover, although the antennas of the present invention are described herein with reference to EAS systems, it will be appreciated that such reference to EAS systems is provided for illustrative purposes only and is not limiting. The antennas of the present invention are well suited for use in many other types of applications, and more particularly, have application in any area in which the electromagnetic energy radiated by the antenna is used to perform a communication or identification function. For instance, the antennas of the present invention can be used in conjunction with a sensor (which is powered, by the electromagnetic energy transmitted by the antenna) in an environment where it is difficult to power or otherwise communicate with the sensor via wires connected to the sensor. In this environment, the antenna could be used to remotely power and receive information from the sensor. For example, the antenna of the present invention could be used in conjunction with a sensor which measures a patient's blood sugar level, wherein the blood sugar level sensor is subcutaneously implanted into a patient's tissue. As will be appreciated, it is highly desirable that the patient's skin not be punctured with wires to connect to the sensor. It is also highly desirable to eliminate batteries from the sensor. With the present invention, it is possible to use the electromagnetic energy generated by the antenna to power the sensor located beneath the patient's skin and to simultaneously use the antenna to receive the electromagnetic energy transmitted by the sensor, where the electromagnetic energy transmitted by the sensor relates to the patient's blood sugar level. Another application is related to communicating with a passive transponder that identifies its owner for access control. Other useful applications of the present invention will also be apparent to those skilled in the art.

It will further be recognized by those skilled in the art that changes may be made to the above-described embodiments of the present invention without departing from the inventive concepts thereof. It is understood, therefore, that the present invention is not limited to the particular embodiments disclosed, but is intended to include all modifications and changes which are within the scope and spirit of the invention as defined by the appended claims.

We claim:

1. A multiple loop antenna comprising:

a first loop element having a generally triangular shape;

a second loop element having a generally triangular shape, wherein the first and second loop elements are of generally equal dimensions and are in generally coplanar, spaced and inverted relationship; and an angled crossover element comprising a pair of spaced, parallel conductors electrically connecting the first and second loop elements, by connecting a third side of the first loop element to a side of the second loop element and a third side of the second loop element to a side of the first loop element, the conductors having a length at least equal to a length of the shortest side of the loop elements.

2. The antenna of claim 1 wherein a horizontal axis extending generally through the geometric center of the antenna bisects the crossover element and separates the first and second loop elements, such that the loop elements are located on opposing sides of the horizontal axis.

3. The antenna of claim 2 wherein the horizontal axis bisects the crossover element and each of the loop elements partially extends over the horizontal axis such that the horizontal axis intersects a portion of each of the first and second loop elements.

4. The antenna of claim 1 wherein a vertical axis extending generally through the geometric center of the antenna bisects the crossover element.

5. The antenna of claim 4 wherein the vertical axis bisects each of the first and second loop elements.

6. The antenna of claim 1 wherein for each of the first and second loop elements, a length of a first side is approximately twice a length of a second side thereof.

7. The antenna of claim 1 wherein the first and second loop elements comprises a single, generally continuous conductor.

8. The antenna of claim 1 further comprising an electrical circuit element connected to the first and second loop elements.

9. The antenna of claim 8 wherein the circuit element comprises a transmitter.

10. The antenna of claim 9 wherein a current generated by the transmitter flows in a first direction in the first loop element and in a second direction, opposite to the first direction, in the second loop element.

11. The antenna of claim 8 wherein the circuit element comprises a receiver.

12. The antenna of claim 8 wherein the circuit element is connected to the loop elements proximate a center of the crossover element and the loops are geometrically symmetric thereabout.

13. The antenna of claim 1 wherein an angle formed between a side of the loop elements and the crossover element connected thereto is greater than 90°.

14. The antenna of claim 1 wherein an angle formed between a side of the loop elements and the crossover element connected thereto is less than 90°.

15. The antenna of claim 1 wherein an angle formed between the third side of each of the loop elements and the crossover element connected thereto is less than 90°.

16. The antenna of claim 1 wherein the size of the antenna is substantially less than a wavelength of operation of the antenna such that the antenna primarily generates magnetic fields.

17. The antenna of claim 1 further comprising a rigid support structure for housing the loop elements and the crossover element.

18. The antenna of claim 1 wherein at least one of the pair of conductors is completely continuous from one end of the crossover element to the other end of the crossover element.

19. The antenna of claim 1 wherein the first loop element, the crossover element, and the second loop element define a zig-zag shape.

20. An electronic article surveillance system comprising:

a transmit circuit element;

a transmit antenna electrically coupled to the transmit circuit element for generating electromagnetic fields, the transmit antenna comprising first and second loop elements of generally equal dimensions, each of the elements being formed generally in the shape of a triangle, the loop elements being in generally coplanar, spaced and inverted relationship to each other and an angled crossover element comprising a pair of spaced, parallel conductors electrically coupling together the first and second loop elements, the conductors having a length at least equal to a length of the shortest side of the loop elements;

a receive antenna spaced from the transmit antenna, the receive antenna being of essentially the same size and geometry as the transmit antenna, wherein a surveillance zone is defined between the transmit antenna and the receive antenna; and a receive circuit element electrically coupled to the receive antenna for detecting resonance of resonant marker or tag in the surveillance zone at a predetermined frequency and generating an alarm signal therefrom indicative of the presence of a protected article in the surveillance zone.

21. The system according to claim 20 wherein at least one of the pair of conductors is completely continuous from one end of the crossover element to the other end of the crossover element.

22. The system according to claim 20 wherein the first loop element, the crossover element, and second loop element of at least one of the transmit and receive antenna define a zig-zag shape.

23. A multiple loop antenna comprising:

a first loop element;

a second loop element; and an angled-crossover element electrically connecting the first and second loop element in series, the crossover element comprising a pair of spaced, generally parallel conductor, wherein the first and second loop elements are of generally equal dimensions and are in Generally coplanar, spaced relationship, at least one of the pair of conductors being completely continuous from one end of the crossover element to the other end of the crossover element, wherein the first and second loop elements are formed by a plurality of sides, and the length of the conductors of the crossover element is at least equal to a length of the shortest side of the loop elements.

24. The multiple loop antenna of claim 23 further comprising a transmitter device for generating currents, wherein the generated currents flow in opposite directions in the first and second loops, thereby generating fields which cancel at a distance.

25. The multiple loop antenna of claim 23 wherein the spaced conductors of the crossover element are closely spaced from each other such that a field generated by one conductor is substantially canceled by a field generated by the other conductor.

26. A multiple loop antenna of claim comprising;

a first loop element;

a second loop element; and an angled crossover element electrically connecting the first and second loop elements in series, the crossover element wherein the first and second loop elements are of generally equal dimensions and are in generally coplanar, spaced relationship, at least one of the pair of conductors being completely continuous from one end of the crossover element to the other end of the crossover element, wherein the first loop element, the crossover element, and the second loop element define a zig-zag shape.

27. A multiple loop antenna comprising:

a first loop element having a generally triangular shape;

a second loop element having a generally triangular shape, wherein the first and second loop elements are of generally equal dimensions and are in generally coplanar, spaced and inverted relationship; and an angled crossover element comprising a pair of spaced, parallel conductors electrically connecting the first and second loop elements, by connecting a third side of the first loop element to a side of the second loop element and a third side of the second loop element to a side of the first loop element, the first loop element, the crossover element, and the second loop element defining a zig-zag shape.

28. An electronic article surveillance system comprising:

a transmit circuit element;

a transmit antenna electrically coupled to the transmit circuit element for generating electromagnetic fields, the transmit antenna comprising first and second loop elements of generally equal dimensions, each of the elements being formed generally in the shape of a triangle, the loop elements being in generally coplanar, spaced and inverted relationship to each other and an angled crossover element comprising a pair of spaced, parallel conductors electrically coupling together the first and second loop elements;

a receive antenna spaced from the transmit antenna, the receive antenna being of essentially the same size and geometry as the transmit antenna, wherein a surveillance zone is defined between the transmit antenna and the receive antenna, the first loop element, the crossover element, and the second loop element of at least one of the transmit and receive antenna defining a zig-zag shape; and a receive circuit element electrically coupled to the receive antenna for detecting resonance of resonant marker or tag in the surveillance zone at a predetermined frequency and generating an alarm signal therefrom indicative of the presence of a protected article in the surveillance zone.

29. A multiple loop antenna comprising:

a first loop element;

a second loop element; and an angled crossover element electrically connecting the first and second loop elements in series, the crossover element comprising a pair of spaced, generally parallel conductors, wherein the first and second loop elements are of generally equal dimensions and are in generally coplanar, spaced relationship, and the first loop element, the crossover element, and the second loop element define a zig-zag shape.

* * * * *